US007819761B2

(12) United States Patent
Kim et al.

(10) Patent No.: US 7,819,761 B2
(45) Date of Patent: Oct. 26, 2010

(54) GOLF BALL HAVING CROSS-CORE HARDNESS DIFFERENTIAL AND METHOD FOR MAKING IT

(75) Inventors: Hyun J. Kim, Carlsbad, CA (US); Hong G. Jeon, Carlsbad, CA (US); Kelvin T. Okamoto, Arlington Heights, IL (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 595 days.

(21) Appl. No.: 11/339,981

(22) Filed: Jan. 25, 2006

(65) Prior Publication Data

US 2006/0166761 A1 Jul. 27, 2006

Related U.S. Application Data

(60) Provisional application No. 60/647,073, filed on Jan. 26, 2005.

(51) Int. Cl.
*A63B 37/06* (2006.01)

(52) U.S. Cl. ..... 473/376
(58) Field of Classification Search ..... 473/376, 473/377
See application file for complete search history.

(56) References Cited

U.S. PATENT DOCUMENTS 6,537,158 B2 * 3/2003 Watanabe ..... 473/374
6,780,126 B2 * 8/2004 Ladd et al. ..... 473/376
6,919,395 B2 * 7/2005 Rajagopalan et al. ..... 524/432

* cited by examiner

*Primary Examiner*—Raeann Trimiew
(74) *Attorney, Agent, or Firm*—Klarquist Sparkman, LLP

(57) ABSTRACT

A golf ball, and method for making it, are disclosed wherein the golf ball includes a core including a center point having a first hardness value and/or first specific gravity value and an outer surface having a second hardness value and/or second specific gravity value. The first and second hardness values and the first and second specific gravity values are different from each other.

28 Claims, 1 Drawing Sheet

GOLF BALL HAVING CROSS-CORE HARDNESS DIFFERENTIAL AND METHOD FOR MAKING IT

CROSS-REFERENCE TO RELATED APPLICATION

Priority is claimed under 35 U.S.C. §119(e) to U.S. Provisional Patent Application No. 60/647,073, filed Jan. 26, 2005, and entitled "Golf Ball Having Cross-Core Hardness Differential and Method for Making It," by Hyun Jin Kim, Hong Guk Jeon, and Kelvin Tsugio Okamoto, which application is incorporated by reference herein.

BACKGROUND OF THE INVENTION

1. Field of the Invention

The present invention relates generally to compositions for use in making golf ball cores. In particular, the invention relates to such golf ball cores having a difference in hardness between the core's outer surface and the core's center point. The present invention also relates to methods for manufacturing these golf ball cores.

2. Description of Related Art

Golf balls generally include a core and at least one cover layer surrounding the core. Material characteristics of the compositions used in the core, and the resulting mechanical properties of the core, are important in determining the golf ball's performance. For example, the core's composition affects the golf ball's coefficient of restitution (C.O.R.), i.e., the ratio of the ball's post-impact speed to pre-impact speed. The C.O.R. affects the ball's speed and distance when hit. The core's composition also affects the ball's compression, i.e., a measure of the deflection of the ball when a standard force is applied to the ball. Cores exhibiting low compression provide for improved ball feel, but also tend to exhibit reduced C.O.R., which results in reduced ball flight distance.

Golf ball cores generally incorporate polybutadiene rubbers cross-linked with sulfur compounds, or peroxides, and a metal salt of an acrylate, such as zinc diacrylate ("ZDA") or zinc dimethacrylate ("ZDMA"). These compositions provide for improved properties; however, despite years of continual improvements in rubber core formulations, ideal properties have not yet been achieved for golf balls. Increasing the loading levels of sulfur compounds, peroxides, or acrylate metal salts in the polybutadiene rubber used for a core composition is known to increase C.O.R. However, this also leads to increased compression, resulting in poorer ball feel and increased driver spin rate, which results in reduced flight distance. This relationship between C.O.R. and compression can be adjusted only to a limited extent using known accelerators, cross-linking agents, and co-cross-linking agents.

In view of the above, it is apparent that improved golf ball cores that result in golf balls having optimal performance, e.g., spin rate value, hit-feel characteristics, and durability, while demonstrating ease of manufacture, as well as methods for making these cores are needed. The present invention fulfills these needs and provides further related advantages.

SUMMARY OF THE INVENTION

Embodiments of the present invention include golf balls having improved golf ball cores that result in the golf balls having improved spin rate values, hit-feel characteristics, and durability. An exemplary golf ball core that embodies the invention includes a center point having a first hardness value, and an outer surface having a second hardness value. The first hardness value is different from the second hardness value.

In other, more detailed features of the invention, the second hardness value is greater than the first hardness value, or the second hardness value is less than the first hardness value. Also, a gradient in hardness value between the first hardness value and the second hardness value across a radius of the golf ball core occurs in discrete increments.

In other, more detailed features of the invention, the golf ball core further includes regions of the golf ball core having discrete hardness values that are arranged concentrically about the center point. When a colorant is dispersed throughout the golf ball core, the resulting golf ball core can include visually distinguishable regions, each having discrete hardness values.

In other, more detailed features of the invention, the golf ball core is formed from a single compression molding step. Also, the golf ball core can be formed from one slug of material.

In other, more detailed features of the invention, the golf ball core has a point along a radius between the center point and the outer surface that has a third hardness value that is different in value from the first hardness value and the second hardness value. The third hardness value can be between the first hardness value and the second hardness value. Also, the third hardness value can be greater than the first hardness value. In addition, the third hardness value can be greater than both the first hardness value and the second hardness value.

In other, more detailed features of the invention, the golf ball core includes an unsaturated polymer and a peptizer. The unsaturated polymer can be selected from the group consisting of 1,2-polybutadiene, cis-1,4-polybutadiene, trans-1,4-polybutadiene, cis-polyisoprene, trans-polyisoprene, polychloroprene, polybutylene, styrene-butadiene rubber, block copolymer of styrene and butadiene, block copolymer of styrene and isoprene, nitrile rubber, silicone rubber, polyurethane, and mixtures thereof. Also, the golf ball core can include greater than about 0.1 part by weight of the peptizer per 100 parts by weight of the unsaturated polymer. The peptizer can be selected from the group consisting of pentachlorothiophenol, a metal salt of pentachlorothiophenol, a non-metal salt of pentachlorothiophenol, and dibenzamido diphenyldisulfide.

In other, more detailed features of the invention, the golf ball core further includes an accelerator. The golf ball core can include greater than about 0.1 part by weight of the accelerator per 100 parts by weight of the unsaturated polymer. Also, the accelerator can be selected from the group consisting of mercapto-accelerator, sulfenamide-accelerator, thiuram accelerator, dithiocarbamate accelerator, dithiocarbamylsulfenamide accelerator, xanthate accelerator, guanidine accelerator, amine accelerator, thiourea accelerator, and dithiophosphate accelerator.

In other, more detailed features of the invention, the golf ball core further includes a cross-linking agent. The cross-linking agent can be an organic peroxide. The cross-linking agent can be selected from the group consisting of diacetyl peroxide, di-tert-butyl peroxide, dibenzoyl peroxide, dicumyl peroxide, 2,5-dimethyl-2,5-di-(benzoylperoxy)hexane, 1,4-bis-(t-butylperoxyisopropyl)benzene, t-butylperoxybenzoate, 2,5-dimethyl-2,5-di-(t-butylperoxy)hexyne-3, 1,1-bis-(t-butylperoxy)-3,3,5-trimethylcyclohexane, di-(2,4-dichlorobenzoyl)peroxide, and mixtures thereof. The golf ball core can include greater than about 0.1 part per hundred of the cross-linking agent per 100 parts by weight of the unsaturated polymer. The cross-linking agent can be a mixture of organic peroxides, with each organic peroxide having a different activation temperature.

In other, more detailed features of the invention, the golf ball core further includes a constituent selected from the group consisting of an initiator, a co-cross-linking agent, an anti-oxidant, a filler, a colorant, and a processing aid. The constituent can be a filler that when added to the unsaturated polymer adjusts the density of the golf ball core. The filler can be selected from the group consisting of zinc oxide, tungsten, and barium sulfate. The core can include from about 10 parts to about 100 parts by weight of the filler per 100 parts per hundred of the unsaturated polymer.

In other, more detailed features of the invention, the golf ball core further includes a nanofiller. The nanofiller can be present in an amount between about 0.1% and about 20% by weight, between about 0.1% and about 15% by weight, between about 0.1% and about 10% by weight, and between about 0.5% and about 5% by weight. Also, the unsaturated polymer in the golf ball core can used to form a matrix polymer. In addition, the nanofiller can be intercalated with the matrix polymer. In addition, the nanofiller can be exfoliated with the matrix polymer.

In other more detailed features of the invention, the nanofiller includes particles of inorganic material, where each particle of inorganic material has a largest dimension that is about one micron or less, and the largest dimension of the particle of inorganic material is at least one order of magnitude greater than a smallest dimension of the particle of inorganic material. In other embodiments, the nanofiller is clay, and the clay can be selected from the group consisting of hydrotalcite, montmorillonite, phyllosilicate, saponite, hectorite, beidellite, stevensite, vermiculite, halloysite, mica, micafluoride, and ostosilicate.

Another exemplary golf ball core that embodies the invention includes a center point having a first specific gravity value, and an outer surface having a second specific gravity value. The first specific gravity value is different from the second specific gravity value.

In other, more detailed features of the invention, the second specific gravity value is greater than the first specific gravity value. Also, a gradient in the specific gravity value between the first hardness value and the second hardness value across a radius of the golf ball core can occur in discrete increments. In addition, the golf ball core can further include regions of the golf ball core having discrete specific gravity values that are arranged concentrically about the center point.

In other, more detailed features of the invention, a discrete specific gravity value for a region of the golf ball core is determined based on the equation $Y=0.03*X+B$, where: Y is the specific gravity value of the region of the golf ball core, Y is greater than about 1, and Y is less than about 1.3; X is a distance of the region from the center point of the golf ball core, X is greater than about 1 inch, and X is less than about 1.62 inches, and the value of X can vary in value plus or minus 0.02 inch; and B is greater than about 0.95, and B is less than about 1.27. Also, a discrete specific gravity value for a region of the golf ball core can be determined based on the equation $Y=0.04*X+B$, where: Y is the specific gravity value of the region of the golf ball core, Y is greater than about 1, and Y is less than about 1.3; X is a distance of the region from the center point of the golf ball core, X is greater than about 1 inch, and X is less than about 1.62 inches, and the value of X can vary in value plus or minus 0.02 inch; and B is greater than about 0.935, and B is less than about 1.26. In addition, a discrete specific gravity value for a region of the golf ball core can be determined based on the equation $Y=0.05*X+B$, where: Y is the specific gravity value of the region of the golf ball core, Y is greater than about 1, and Y is less than about 1.3; X is a distance of the region from the center point of the golf ball core, X is greater than about 1 inch, and X is less than about 1.62 inches, and the value of X can vary in value plus or minus 0.02 inch; B is greater than about 0.919, and B is less than about 1.25.

In other more detailed features of the invention, a colorant is dispersed throughout the golf ball core resulting in visually distinguishable regions each having discrete specific gravity values. Also, the golf ball core includes a point along a radius between the center point and the outer surface that has a third specific gravity value that is different in value from the first specific gravity value and the second gravity value.

An exemplary golf ball that embodies the invention includes a golf ball core having a center point with a first hardness value, and an outer surface with a second hardness value; and one or more layers that enclose the golf ball core. The first hardness value is different from the second hardness value.

In other, more detailed features of the invention, the one or more layers that enclose the golf ball core include an outermost layer. The outermost layer can include a polymer selected from the group consisting of thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene catalyzed polymers, styrene-acrylonitrile (SAN) (including olefin-modified SAN and acrylonitrile-styrene-acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, and any metallocene-catalyzed polymers of these species. Also, the outermost layer can include an ionomeric polymer selected from the group consisting of α-olefin/unsaturated carboxylic acid, copolymer-type ionomeric resin, and terpolymer-type ionomeric resin.

In other, more detailed features of the invention, the one or more layers that enclose the golf ball core includes an intermediate layer located between the outermost layer and the golf ball core. The intermediate layer can include a polymer selected from the group consisting of thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene catalyzed polymers, styrene-acrylonitrile (SAN) (including olefin-modified SAN and acrylonitrile-styrene-acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, and any metallocene-catalyzed polymers of these species. Also, the intermediate layer can include an ionomeric polymer selected from the group consisting of α-olefin/unsaturated carboxylic acid, copolymer-type ionomeric resin, and terpolymer-type ionomeric resin.

In other, more detailed features of the invention, the intermediate layer and or outermost layer can include the nanofiller, as discussed previously.

Another exemplary golf ball that embodies the invention includes a golf ball core having a center point with a first specific gravity value, and an outer surface with a second specific gravity value; and one or more layers that enclose the golf ball core. The first specific gravity value is different from the second specific gravity value.

An exemplary method for processing a golf ball core according to the invention includes the steps of providing a material that includes an unsaturated polymer and a peptizer, and molding the material into the golf ball core that has a center point and an outer surface. After processing the golf ball core, the center point has a first hardness value and the outer surface has a second hardness value, where the first hardness value is different from the second hardness value.

In other, more detailed features of the invention, the step of providing the material includes the addition of a colorant to the material. Also, the step of providing the material can include the addition of an accelerator to the material. In addition, the step of providing the material can include the addition of a cross-linking agent to the material.

In other, more detailed features of the invention, the step of providing the material includes the addition of a constituent selected from the group consisting of an initiator, a co-cross-linking agent, an anti-oxidant, a filler, a colorant, and a processing aid. Also, the step of providing the material can include the mixing of the material. In addition, the material can be molded in a single compression molding step. Also, the method can further include the step of applying energy selected from the group consisting of thermal energy and radiational energy to the material to induce cross-linking.

Another exemplary method for processing a golf ball core according to the invention includes the step of providing a material that includes an unsaturated polymer and a peptizer, and molding the material into the golf ball core that has a center point and an outer surface. After processing the golf ball core, the center point has a first specific gravity value and the outer surface has a second specific gravity value, where the first specific gravity value is different from the second specific gravity value.

Another exemplary golf ball that embodies the invention includes a golf ball core, a cover layer that encloses the golf ball core, and one or more intermediate layer(s) located between the cover layer and the golf ball core. The golf ball core includes a core center piece that, in turn, includes a center point, and one or more core layer(s) that enclose the core center piece and include an outer surface. The core center point has a first hardness value and/or first specific gravity value, and the outer surface has a second hardness value and/or second specific gravity value. The first hardness value, or first specific gravity value, is different from the second hardness value, or second specific gravity value, respectively.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein. All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

DETAILED DESCRIPTION OF THE PREFERRED EMBODIMENTS AND METHODS

Figure 1:
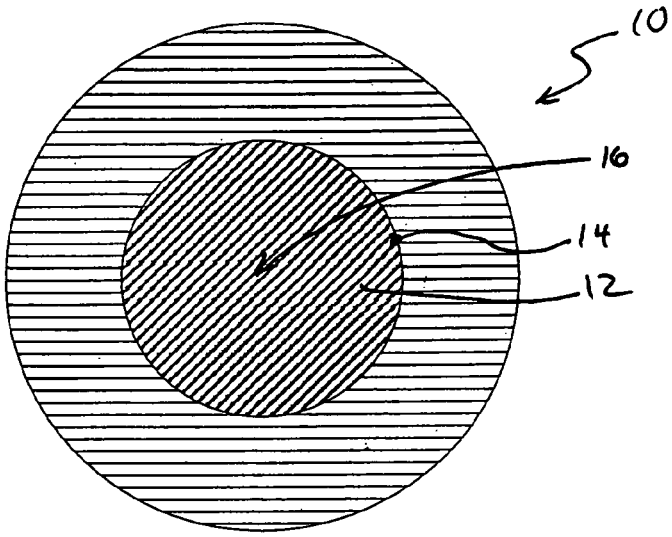
FIG. 1 is a cross-sectional view of a two-piece golf ball.

With reference now to the illustrative drawings, and particularly to FIG. 1, there is shown a cross-sectional view of a golf ball 10 embodying the present invention. The golf ball includes a core 12 having an outer surface 14 where a surface hardness value can be measured that is different in value from the hardness value measured at a center point 16 of the core. Likewise, a surface specific gravity value can be measured on the core's outer surface that is different in value from a center specific gravity value measured at the center point. For example, the surface hardness value, or the surface specific gravity value, can be greater than, or less than, the center hardness value, or the center specific gravity value, respectively. The change in hardness value and specific gravity value between the outer surface and center point across a radius of the golf ball core results in a hardness gradient and a specific gravity gradient, respectively, that can occur in discrete increments, which can result in regions (not shown) of the core having discrete hardness and specific gravity values that are concentrically arranged about the core's center point.

Also, the golf ball core 12 can include a point (not shown) along a radius (not shown) between the center point 16 and the outer surface 14 of the core that has an additional hardness value and specific gravity value that are different from the surface hardness and specific gravity values, respectively, and the center hardness and specific gravity values, respectively. These additional hardness and specific gravity values can have the following: a value between the value measured at the outer surface and the value measured at the center point; a value greater than the value measured at the center point; or greater than both the value measured at the center point and the value measured at the outer surface.

The golf ball core 12 can include regions (not shown) that have discrete hardness value and/or specific gravity values, which are arranged concentrically about the center point 16 of the core. In particular, a discrete specific gravity value for a region of the golf ball core can be determined based on the equation $Y=0.03*X+B$, where:

a. Y is the specific gravity value of the region of the golf ball core, Y is greater than about 1, and Y is less than about 1.3;

b. X is a distance of the region from the center point of the golf ball core, X is greater than about 1 inch, X is less than about 1.62 inches, and the value of X can vary in value plus or minus 0.02 inch; and c. B is greater than about 0.95, and B is less than about 1.27.

More preferably, a discrete specific gravity value for a region (not shown) of the golf ball core 12 can be determined based on the equation Y=0.04*X+B, where:

a. Y is the specific gravity value of the region of the golf ball core, Y is greater than about 1, and Y is less than about 1.3;

b. X is a distance of the region from the center point 16 of the golf ball core, X is greater than about 1 inch, X is less than about 1.62 inches, and the value of X can vary in value plus or minus 0.02 inch; and c. B is greater than about 0.935, and B is less than about 1.26.

Most preferably, a discrete specific gravity value for a region (not shown) of the golf ball core 12 can be determined based on the equation Y=0.05*X+B, where:

a. Y is the specific gravity value of the region of the golf ball core, Y is greater than about 1, and Y is less than about 1.3;

b. X is a distance of the region from the center point 16 of the golf ball core, X is greater than about 1 inch, X is less than about 1.62 inches, and the value of X can vary in value plus or minus 0.02 inch; and c. B is greater than about 0.919, and B is less than about 1.25.

Figure 2:
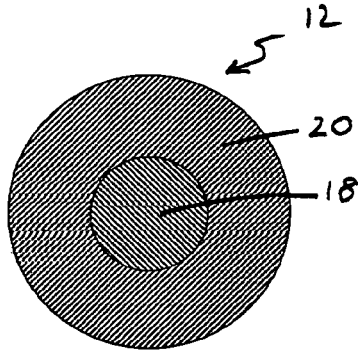
FIG. 2 is a cross-sectional view of a two-piece golf ball core.
Figure 3:
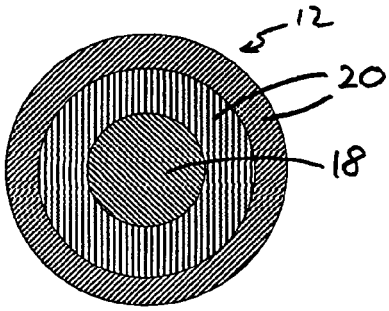
FIG. 3 is a cross-sectional view of a three-piece golf ball core.

The golf ball core 12 can include more than one piece. For example, referring to FIG. 2, the golf ball core can include two pieces; a core center piece 18 and a core layer 20, which surrounds the core center piece. In other embodiments, referring to FIG. 3, the golf ball core can include three pieces; a core center piece and two core layer(s). While FIGS. 1, 2, and 3 show golf ball cores made up a single piece, two pieces, and three pieces, respectively, embodiments of the golf ball core can include more than three pieces.

Figure 4:
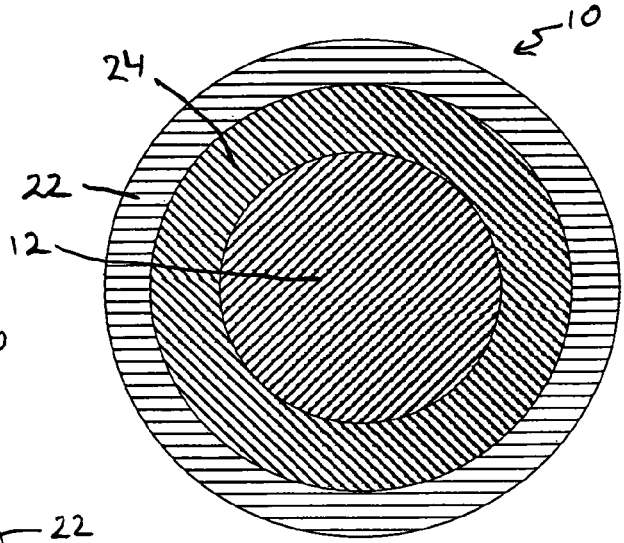
FIG. 4 is a cross-sectional view of a three-piece golf ball.
Figure 5:
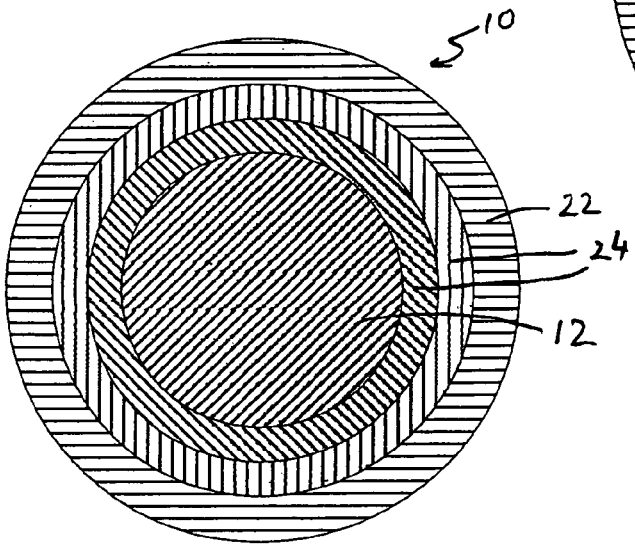
FIG. 5 is a cross-sectional view of a four-piece golf ball.

The golf ball 10 also includes a golf ball cover layer 22, the outermost layer, that surrounds the core 12, and can include, as shown in FIGS. 4 and 5, one or more golf ball intermediate layer(s) 24, which are located between the golf ball's cover layer and the golf ball's core. The golf ball components, i.e., the golf ball core, including the core center piece 18 and core layer(s) 20; intermediate layer(s); and cover layer are not drawn to scale in FIGS. 1-5. The diameters or thicknesses of each of the golf ball components can take on a wide range of values.

The difference in hardness and specific gravity between the core's outer surface 14 and the center point 16 is correlated to optimal performance characteristics for the golf ball 10. More specifically, in the present invention, the difference between the surface hardness and the center hardness, or the surface specific gravity and the center specific gravity, can be adjusted during fabrication to affect overall ball properties, e.g., hit-feel characteristics, C.O.R. value, compression value, and durability.

The difference in hardness and specific gravity between the outer surface 14 and center point 16 of the core 12, or between other points in the core, is obtained when the cross-linking density and/or chain length between cross-linked junctions measured at the one point in the core is different from another point in the core. This difference can be controlled by changing the density of the rubber in the core and/or changing the cross-linking conditions, e.g., the cross-linking temperature and/or the cross-linking time during fabrication of the core. Decreasing the cross-linking temperature and/or increasing the cross-linking time during fabrication of the core will lower the difference in hardness and specific gravity between the core's outer surface and the center point of the core. Another factor affecting the difference in hardness and specific gravity between the core's outer surface and center point, or other parts of the core is the cooling rate of the core. The difference in hardness and specific gravity increases in value when the cooling rate of the core is increased.

When a dye, colorant, is added to a material that makes up the core 12, regions (not shown) of the core are visually distinguishable from other regions of the core that have a different density, and thus, a different hardness value and specific gravity value. In particular, a region of the core that has a higher density, and thus, a higher hardness value and specific gravity value will include more colorant than a region of the core that has a lower density, and thus, a lower hardness value and specific gravity value. Therefore, the use of the colorant in the core can result in visually distinct regions in the core that have discrete hardness and specific gravity values. In particular, because regions in the core that have discrete hardness and specific gravity values tend to form concentrically about the core's center point 16, the use of colorant in the core typically results in visually distinct concentric regions (not shown) about the core's center point.

The golf ball cores 12 of the present invention incorporate a composition that includes an unsaturated polymer and a peptizer. The golf ball composition can also include an accelerator. The core compositions can be cured by a single organic peroxide or a mixture of organic peroxides having different activation temperatures. The composition of the unsaturated polymer, with the peptizer, and with or without the accelerator, allows for the adjustment of the difference in hardness and specific gravity between the golf ball core's center point 16 and outer surface 14 during manufacturing, while providing for increased C.O.R. and compression. The present invention also resides in methods of manufacture for the golf ball cores. These golf ball cores are easy to prepare, and they can tailored to meet a wide range of specifications and preferred performance.

Unsaturated polymers suitable for use in the golf ball cores 12 of the present invention include any polymeric material having an unsaturation, either hydrocarbon or non-hydrocarbon, capable of participating in a cross-linking reaction initiated thermally, chemically, by irradiation, or by a combination of these methods. Non-limiting examples of suitable unsaturated polymers include 1,2-polybutadiene, cis-1,4-polybutadiene, trans-1,4-polybutadiene, cis-polyisoprene, trans-polyisoprene, polychloroprene, polybutylene, styrene-butadiene rubber, styrene-butadiene-styrene block copolymer, styrene-isoprene-styrene block copolymer, nitrile rubber, silicone rubber, polyurethane, as well as functionalized equivalents and mixtures of these.

The base rubber used herein can be any rubber commonly used in golf ball cores 12. Polybutadiene rubbers, especially 1,4-polybutadiene rubbers containing at least 40 mol %, and more preferably 80 to 100 mol % of cis-1,4 bonds, are preferred because of their high rebound resilience, extrusion moldability, and high strength after vulcanization. The 1,4-polybutadiene rubbers can be blended with natural rubber, polyisoprene rubber, styrene-butadiene rubber, or the like. At least 80% by weight of 1,4-polybutadiene rubber should be present in the base rubber, because base rubbers containing less 1,4-polybutadiene rubber often fail to take advantage of the rebound resilience of the polybutadiene rubber.

Many different types of 1,2-polybutadienes exist, having widely varying physical properties as a result of their differing tacticity, crystallinity, and molecular weight. Examples of 1,2-polybutadienes having differing tacticity, all of which are suitable as unsaturated polymers for use in the present invention, are atactic 1,2-polybutadiene, isotactic 1,2-polybutadiene, and syndiotactic 1,2-polybutadiene. Syndiotactic polymers include alternating base units that are enantiomers of each other. These 1,2-polybutadienes are also differentiated by their crystallinity, which ranges from amorphous 1,2-polybutadiene that essentially lacks crystallinity to semi-crystalline 1,2-polybutadiene that has different crystalline structures. The molecular weights of these 1,2-polybutadienes vary greatly. The various combinations of tacticity, crystallinity, and molecular weight provide for many different types of 1,2-polybutadienes having very different processability, as well as other chemical, thermal, mechanical, and rheological properties.

Syndiotactic 1,2-polybutadiene having a crystallinity suitable for use as an unsaturated polymer in compositions within the scope of the present invention are polymerized from a 1,2-addition of butadiene. Golf ball cores 12 within the scope of the present invention include syndiotactic 1,2-polybutadiene having crystallinity and greater than about 70% of 1,2-bonds, more preferably greater than about 80% of 1,2-bonds, and most preferably greater than about 90% of 1,2-bonds. Also, golf ball cores within the scope of the present invention include syndiotactic 1,2-polybutadiene having crystallinity between about 5% and about 50%, more preferably between about 10% and about 40%, and most preferably between about 15% and about 30%. In addition, golf ball cores within the scope of the present invention include syndiotactic 1,2-polybutadiene having crystallinity and a mean molecular weight between about 10,000 and about 350,000, more preferably between about 50,000 and about 300,000, more preferably between about 80,000 and about 200,000, and most preferably between about 100,000 and about 150,000. An example of a suitable syndiotactic 1,2-polybutadiene having crystallinity for use in golf ball cores within the scope of the present invention is sold under the trade name RB810, RB820, and RB830 by JSR Corporation of Tokyo, Japan. These have more than 90% 1,2 bonds, a mean molecular weight of approximately 120,000, and a crystallinity between about 15% and about 30%.

Peptizers can be defined as chemicals that inhibit cross-linking during the processing of unsaturated polymers, and then further participates in the cross-linking of the unsaturated polymer when cross-linking does begin. The peptizer comprises an organic sulfur compound and/or its metal or non-metal salt. Examples of the organic sulfur compound include: thiophenols, such as pentachlorothiophenol and its metal and non-metal salts, 4-butyl-o-thiocresol, 4 t-butyl-p-thiocresol, and 2-benzamidothiophenol; thiocarboxylic acids, such as thiobenzoic acid; 4,4' dithio dimorpholine; sulfides, such as dixylyl disulfide, dibenzoyl disulfide; dibenzothiazyl disulfide; di(pentachlorophenyl) disulfide; dibenzamido diphenyldisulfide (DBDD); and alkylated phenol sulfides, such as VULTAC marketed by Atofina Chemicals, Inc. of Philadelphia, Pa. Examples of the metal salts of an organic sulfur compound include zinc salts of the above-mentioned thiophenols and thiocarboxylic acids. Examples of non-metal salts of an organic sulfur compound include the amine or ammonium salts of the above-mentioned thiophenols and thiocarboxylic acids. Preferred peptizers include pentachlorothiophenol, its metal salts and its non-metal salts, and dibenzamido diphenyldisulfide. Peptizers can be used alone or in an admixture of two or more peptizers. When the golf ball core composition includes a peptizer, the composition has greater than about 0.1 part by weight of the peptizer per 100 parts the unsaturated polymer.

Accelerators, which can be defined as chemicals that increase the vulcanization rate and/or decrease the vulcanization temperature of the unsaturated polymers, can be of any class known for rubber processing including mercapto-, sulfenamide-, thiuram, dithiocarbamate, dithiocarbamyl-sulfenamide, xanthate, guanidine, amine, thiourea, and dithiophosphate accelerators. Specific commercial accelerators include 2-merpatobenzothiazole and its metal or non-metal salts such as Vulkacit Mercapto C, Mercapto MGC, Mercapto ZM-5, and ZM marketed by Bayer AG of Leverkusen, Germany; Nocceler M, Nocceler MZ, and Nocceler M-60 marketed by Ouchisinko Chemical Industrial Company, Ltd. of Tokyo, Japan; and MBT and ZMBT marketed by Akrochem Corporation of Akron, Ohio. A more complete list of commercially available accelerators is given in *The Vanderbilt Rubber Handbook:* 13$^{th}$ *Edition* (1990, R.T. Vanderbilt Co.), pp. 296-330, the *Encyclopedia of Polymer Science and Technology*, Vol. 12 (1970, John Wiley & Sons), pp. 258-259, and the *Rubber Technology Handbook* (1980, Hanser/Gardner Publications), pp. 234-236. Preferred accelerators include 2-mercaptobenzothiazole (MBT) and its salts. The golf ball core composition can incorporate greater than about 0.1 part by weight of the accelerator per 100 parts by weight of the unsaturated polymer.

Suitable cross-linking agents for use in the golf ball cores 12 of the present invention include any sulfur compounds, peroxides, or other known chemical cross-linking agents, as well as mixtures of these. Non-limiting examples of suitable cross-linking agents include primary, secondary, or tertiary aliphatic or aromatic peroxides. Peroxides containing more than one peroxy group can be used, such as 2,5-dimethyl-2,5-di(tert-butylperoxy)hexane and 1,4-di-(2-tert-butyl peroxyisopropyl)benzene. Both symmetrical and asymmetrical peroxides can be used, for example, tert-butyl perbenzoate and tert-butyl cumyl peroxide. Peroxides incorporating carboxyl groups also are suitable. The cross-linking agent can be an organic peroxide, or a mixture of organic peroxides. When the golf ball core includes a mixture of organic peroxides, each organic peroxide can have a different activation temperature. The decomposition of peroxides used as cross-linking agents in the present invention can be brought about by applying thermal energy, shear, irradiation, reaction with other chemicals, or any combination of these.

Both homolytically and heterolytically decomposed peroxide can be used in the golf ball cores 12 of the present invention. Non-limiting examples of suitable peroxides include: diacetyl peroxide; di-tert-butyl peroxide; dibenzoyl peroxide; dicumyl peroxide; 2,5-dimethyl-2,5-di(benzoylperoxy)hexane; 1,4-bis-(t-butylperoxyisopropyl)benzene, t-butylperoxybenzoate; 2,5-dimethyl-2,5-di-(t-butylperoxy) hexyne-3; 1,1-bis(t-butylperoxy)-3,3,5 tri-methylcyclohexane, such as Varox 231-XL, marketed by R.T. Vanderbilt Co., Inc. of Norwalk, Conn.; di-(2,4-dichlorobenzoyl)peroxide; and mixtures thereof. The cross-linking agent can be blended in amounts greater than about 0.1 part per hundred of the cross-linking agent per 100 parts by weight of the unsaturated polymer.

The metal salt of unsaturated carboxylic acid can be blended with the rubber of the golf ball core 12 as a co-cross-linking agent. Examples of these include zinc and magnesium salts of unsaturated fatty acids having 3 to 8 carbon atoms, such as acrylic acid, methacrylic acid, maleic acid, palmitic acid, and fumaric acid, with the zinc salts of acrylic and methacrylic acid being most preferred. The unsaturated carboxylic acid metal salt can be blended in a rubber either as a preformed metal salt, or by introducing an $\alpha,\beta$-unsaturated carboxylic acid and a metal oxide or hydroxide into the rubber composition, and allowing them to react in the rubber composition to form a metal salt. The unsaturated carboxylic acid metal salt can be blended in any desired amount, but preferably in amounts of about 20 parts to about 60 parts by weight of the unsaturated carboxylic acid per 100 parts by weight of the unsaturated polymer.

Besides the use of chemical cross-linking agents, exposure of the golf ball core composition to radiation also can serve as a cross-linking agent, with or without a chemical cross-linking agent. Radiation can be applied to the unsaturated polymer and peptizer mixture, with or without a chemical cross-linking agent, by any known method, including using microwave or gamma radiation, or an electron beam device.

Golf ball cores 12 within the scope of the present invention also can include, in suitable amounts, one or more additional ingredients generally employed in golf ball compositions. Agents provided to achieve specific functions, such as additives and stabilizers, can be present. Suitable ingredients include initiators, colorants, UV stabilizers, photo stabilizers, antioxidants, dispersants, mold releasing agents, processing aids, fillers, and fibers. The golf ball core compositions can incorporate, for example, inorganic fillers, such as titanium dioxide, calcium carbonate, zinc sulfide, or zinc oxide. Additional fillers can be chosen to adjust the density of the golf ball core composition, such as zinc oxide, barium sulfate, tungsten, or any other metallic powder having a density higher than that of the base polymeric resin. Any organic, inorganic, or metallic fibers, either continuous or non-continuous, also can be in the composition. An example of these is silica-containing filler, which preferably is selected from finely divided, heat-stable minerals, such as fumed and precipitated forms of silica, silica aerogels, and titanium dioxide having a specific surface area of at least about 10 $m^2$/gram. Preferred examples of fillers include metal oxides, such as zinc oxide and magnesium oxide. The filler can be blended in amounts of about 10 parts by weight per 100 parts by weight of the unsaturated polymer. If desired, the rubber composition can additionally contain a plasticizer, an antioxidant, and any other additives generally employed in the preparation of one-piece balls or the cores of multi-layered balls. The appropriate amounts for these materials can be readily determined without undue experimentation.

In yet another more detailed feature of this invention, the composition of the core 12 or core components, i.e., the core center piece 18 and the core layer(s) 20, can include one or more nanofillers in the thermoplastic or thermoset matrix polymer. Nanofiller includes particles of inorganic material having a largest dimension that is about one micron or less, and the largest dimension is at least an order of magnitude greater than the particle's smallest dimension. Inorganic nanofiller material generally is made of clay, such as hydrotalcite, phyllosilicate, saponite, hectorite, beidellite, stevensite, vermiculite, halloysite, mica, montmorillonite, micafluoride, or octosilicate. Examples of commercial nanofillers include various Cloisite grades including 10A, 15A, 20A, 25A, 30B, and NA+ from Southern Clay Products of Gonzales, Tex.; and the Nanomer grades including 1.24TL and C.30EVA from Nanocor, Inc. of Arlington Heights, Ill. The nanofiller is present in the thermoplastic or thermoset polymer in an amount of about 0.1% to about 20%, more preferably from about 0.1% to about 15%, even more preferably from about 0.1% to about 10%, and most preferably from about 0.5% to about 5% by weight.

The nanofiller material can be incorporated into the polymer either by dispersion into the particular monomer or oligomer prior to polymerization, or by melt compounding of the particles into the matrix polymer. The nanofiller can be dispersed in the thermoplastic or thermoset matrix polymer in an intercalated or exfoliated manner. To facilitate incorporation of the nanofiller material into the polymer material, either during the preparation of the nanocomposite materials or during the preparation of the polymer-based golf ball compositions, the nanofiller particles, e.g., particles of clay, generally are coated or treated by a suitable compatibilizing agent. The compatibilizing agent allows for superior linkage between the inorganic and organic material, and it also can account for the hydrophilic nature of the inorganic nanofiller material and the possibly hydrophobic nature of the polymer. Compatibilizing agents can exhibit a variety of different structures depending upon the nature of both the inorganic nanofiller material and the target matrix polymer. Non-limiting examples of compatibilizing agents include hydroxy-, thiol-, amino-, epoxy-, carboxylic acid-, ester-, amide-, and siloxy-group containing compounds, oligomers, or polymers.

As mentioned above, the nanofiller particles have an aggregate structure with the aggregate particle's size in the micron range and above. These aggregates have a stacked plate structure, with the individual platelets being roughly 1 nanometer ("nm") thick and 100 nm to 1000 nm across. As a result, nanofillers can have extremely large values of surface area, resulting in high reinforcement efficiency to the material at low loading levels of the particles. The sub-micron-sized particles enhance the stiffness of the material, without increasing its weight or opacity, and without reducing the material's low-temperature toughness.

Nanofillers can be mixed into a matrix polymer in three ways. In one type of mixing there is dispersion of the aggregate structures within the matrix polymer, but, during mixing, no interaction of the matrix polymer with the aggregate platelet structure occurs. Thus, the stacked platelet structure is essentially maintained. This type of mixing is referred to as "undispersed."

However, if the nanofiller material is selected correctly, the matrix polymer chains can penetrate into the aggregates, and separate the platelets. Thus, when viewed by transmission electron microscopy ("TEM") or x-ray diffraction, the aggregates of platelets are expanded. When this occurs, the nanofiller is said to be substantially evenly dispersed within, and reacted into, the structure of the matrix polymer. This level of expansion can occur to differing degrees. If small amounts of the matrix polymer are layered between the individual platelets then, this type of mixing is referred to as "intercalation."

In some cases, further penetration of the matrix polymer chains into the aggregate structure separates the platelets, and leads to a complete breaking up of the platelet's stacked structure in the aggregate. Thus, when viewed by a TEM, the individual platelets are mixed thoroughly throughout the matrix polymer. This type of mixing is referred to as "exfoliated." The platelets of an exfoliated nanofiller are dispersed fully throughout the polymer matrix. Preferably the platelets are dispersed evenly throughout the polymer matrix, however, the platelets can be dispersed unevenly.

While not wishing to be limited to any theory, one possible explanation of the differing degrees of dispersion of such nanofillers within the matrix polymer structure is the effect of the compatibilizer surface coating on the interaction between the nanofiller platelet structure and the matrix polymer. By careful selection of the nanofiller it is possible to vary the penetration of the matrix polymer into the platelet structure of the nanofiller on mixing. Thus, the degree of interaction and intrusion of the polymer matrix into the nanofiller controls the separation and dispersion of the individual platelets of the nanofiller within the polymer matrix. This interaction of the polymer matrix and the platelet structure of the nanofiller is referred to as the nanofiller "reacting into the structure of the polymer," and the subsequent dispersion of the platelets within the polymer matrix is referred to as the nanofiller "being substantially evenly dispersed" within the structure of the polymer matrix.

If no compatibilizer is present on the surface of a filler, e.g., a clay, or if an attempt is made to coat the filler with the compatibilizer after its addition to the polymer matrix, then the penetration of the matrix polymer into the nanofiller is much less efficient. In these instances, very little separation, and no dispersion, of the individual platelets occurs within the matrix polymer.

The physical properties of the polymer change with the addition of a nanofiller, and the physical properties of the polymer are expected to improve even more as the nanofiller is dispersed into the polymer matrix to form a nanocomposite. Materials incorporating nanofiller materials can provide these property improvements at much lower densities than materials incorporating conventional fillers. For example, a nylon-6 nanocomposite material manufactured by RTP Corporation of Wichita, Kans. uses a 3% to 5% clay loading, and has a tensile strength of 11,800 psi and a specific gravity of 1.14. In contrast, a conventional 30% mineral-filled material has a tensile strength of 8,000 psi and a specific gravity of 1.36. Because the use of nanocomposite materials with lower loadings of inorganic materials than conventional fillers provides the same or similar properties, the use of nanofillers allows products to be lighter than those incorporating conventional fillers, while maintaining those same properties.

Nanocomposite materials are materials that include from about 0.1% to about 20%, preferably from about 0.1% to about 15%, and most preferably from about 0.1% to about 10% of nanofiller reacted into, and substantially dispersed through intercalation or exfoliation into, the structure of an organic material, such as a polymer, to provide strength, temperature resistance, and other property improvements to the resulting composite. Descriptions of particular nanocomposite materials and their manufacture can be found in U.S. Pat. Nos. 5,962,553 to Ellsworth, U.S. Pat. No. 5,385,776 to Maxfield et al., and U.S. Pat. No. 4,894,411 to Okada et al. Examples of nanocomposite materials currently marketed include M1030D manufactured by Unitika Limited, of Osaka, Japan, and 1015C2 manufactured by UBE America of New York, N.Y.

When nanocomposites are blended with other polymer systems, the nanocomposite can be considered a type of nanofiller concentrate. However, in general, a nanofiller concentrate can be considered a polymer into which nanofiller is mixed. A nanofiller concentrate does not require that the nanofiller has been reacted and/or dispersed evenly into the carrier polymer.

The above described golf ball core composition can be used in the core of two-piece, three-piece, and multi-layered golf balls 10. The golf ball intermediate layer(s) 24 and golf ball cover layer 22 can incorporate one or more polymers. Examples of suitable additional polymers for use in the intermediate layer(s) and/or cover layer of the present invention include, but are not limited to, the following: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene catalyzed polymers, styrene-acrylonitrile (SAN) (including olefin-modified SAN and acrylonitrile-styrene-acrylonitrile), styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, and polysiloxane or any metallocene-catalyzed polymers of these species.

Suitable polyamides for use as an additional material in the golf ball's intermediate layer(s) 24 and/or cover layer 22 within the scope of the present invention also include resins obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine, or m-xylylenediamine; (2) a ring-opening polymerization of cyclic lactam, such as ϵ-caprolactam or ω-laurolactam; (3) polycondensation of an aminocarboxylic acid, such as 6-aminocaproic acid, 9-aminononanoic acid, 11-aminoundecanoic acid, or 12-aminododecanoic acid; or (4) copolymerization of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

Other preferred materials suitable for use as an additional material in golf ball compositions included in the intermediate layer(s) 24 and/or cover layer 22 within the scope of the present invention include polyester elastomers marketed under the tradename SKYPEL by SK Chemicals of South Korea, or diblock or triblock copolymers marketed under the tradename SEPTON by Kuraray Corporation of Kurashiki, Japan, and KRATON by Kraton Polymers Group of Companies of Chester, United Kingdom.

Silicone materials also are well suited for blending into the compositions of the intermediate layer(s) 24 and/or cover layer 22 within the scope of the present invention. These may be monomers, oligomers, prepolymers, or polymers, with or without additional reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl, and decenyl. The alkenyl functionality may be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl and xylyl; aralkyl groups, such as benzyl and phenethyl; and halogenated alkyl groups, such as 3,3,3-trifluoropropyl and chloromethyl.

Another type of silicone material suitable for use in the present invention is one having hydrocarbon groups that lack aliphatic unsaturation. Specific examples of suitable silicones for use in making compositions of the present invention include the following: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxy-endblocked methylphenylsiloxane-dimethylsiloxane-methylvinylsiloxane copolymers; dimethylvinylsiloxy-endblocked dimethylpolysiloxanes; dimethylvinylsiloxy-endblocked dimthylsiloxane-methylvinlysiloxane copolymers; dimethylvinylsiloxy-endblocked methylphenylsiloxane-dimethylsiloxane-methylvinylsiloxane copolymers; and, the copolymers listed above, in which at least one end group is dimethylhydroxysiloxy. Commercially available silicones suitable for use in compositions within the scope of the present invention include Silastic by Dow Corning Corp. of Midland, Mich., Blensil by GE Silicones of Waterford, N.Y., and Elastosil by Wacker Silicones of Adrian, Mich.

Other types of copolymers also may be added to the compositions of the golf ball's intermediate layer(s) 24 and/or cover layer 22 within the scope of the present invention. Examples of copolymers comprising epoxy monomers and which are suitable for use within the scope of the present invention include styrene-butadiene-styrene block copolymers, in which the polybutadiene block contains an epoxy group, and styrene-isoprene-styrene block copolymers, in which the polyisoprene block contains epoxy. Commercially available examples of these epoxy functional copolymers include ESBS A1005, ESBS A1010, ESBS A1020, ESBS AT018, and ESBS AT019 marketed by Daicel Chemical Industries, Ltd.

Ionomers also are well suited for blending into the compositions of the intermediate layer(s) 24 and/or cover layer 22 within the scope of the present invention. Suitable ionomeric polymers (i.e., copolymer- or terpolymer-type ionomers) include α-olefin/unsaturated carboxylic acid copolymer-type ionomeric or terpolymer-type ionomeric resins. Copolymeric ionomers are obtained by neutralizing at least a portion of the carboxylic groups in a copolymer of an α-olefin and an α,β-unsaturated carboxylic acid having 3 to 8 carbon atoms, with a metal ion. Examples of suitable α-olefins include ethylene, propylene, 1-butene, and 1-hexene. Examples of suitable unsaturated carboxylic acids include acrylic, methacrylic, ethacrylic, α-chloroacrylic, crotonic, maleic, fumaric, and itaconic acid. Copolymeric ionomers include ionomers having varied acid contents and degrees of acid neutralization, neutralized by monovalent or bivalent cations discussed above.

Terpolymeric ionomers are obtained by neutralizing at least a portion of the carboxylic groups in a terpolymer of an α-olefin, and an α,β-unsaturated carboxylic acid having 3 to 8 carbon atoms and an α,β-unsaturated carboxylate having 2 to 22 carbon atoms with metal ion. Examples of suitable α-olefins include ethylene, propylene, 1-butene, and 1-hexene. Examples of suitable unsaturated carboxylic acids include acrylic, methacrylic, ethacrylic, α-chloroacrylic, crotonic, maleic, fumaric, and itaconic acid. Terpolymeric ionomers include ionomers having varied acid contents and degrees of acid neutralization, neutralized by monovalent or bivalent cations as discussed above. Examples of suitable ionomeric resins include those marketed under the name SURLYN manufactured by E.I. du Pont de Nemours & Company of Wilmington, Del., and IOTEK manufactured by Exxon Mobil Corporation of Irving, Tex.

Other types of copolymers also can be added to compositions within the scope of the present invention. Examples of copolymers comprising epoxy monomers and which are suitable for use within the scope of the present invention include styrene-butadiene-styrene block copolymers, in which the polybutadiene block contains an epoxy group, and styrene-isoprene-styrene block copolymers, in which the polyisoprene block contains epoxy. Commercially available examples of these epoxy functional copolymers include ESBS A1005, ESBS A1010, ESBS A1020, ESBS AT018, and ESBS AT019 marketed by Daicel Chemical Industries, Ltd. of Osaka, Japan.

The composition of the intermediate layer(s) 24 and/or the cover layer 22 can include one or more so-called "modified ionomers," examples of which are described in U.S. Pat. Nos. 6,100,321, 6,329,458, and 6,616,552, and in U.S. Patent Application Publication No. 2003/0158312, the entire contents of these patents and patent application publication are incorporated by reference herein.

More specifically, the composition of the intermediate layer(s) 24 and/or the cover layer 22 includes one or more modified ionomeric polymers that are prepared by mixing the following:

a. an ionomeric polymer comprising ethylene, 5 to 25 weight percent (meth)acrylic acid, and 0 to 40 weight percent of a $C_1$-$C_8$ (meth)acrylate monomer, where the ionomeric polymer is neutralized with metal ions selected from the group consisting of lithium, sodium, zinc, calcium, magnesium, and mixtures thereof; and
b. one or more fatty acids, or metal salts of a fatty acid, where the metal is selected from the group consisting of calcium, sodium, zinc, lithium, barium, and magnesium, and where the fatty acid preferably is stearic acid.

The fatty or waxy acid salts utilized in the composition of the intermediate layer(s) 24 and/or the cover layer 22 are composed of a chain of alkyl groups containing about 4 to about 75 carbon atoms (usually even numbered) and characterized by a —COOH terminal group. The generic formula for all fatty and waxy acids above acetic acid is $CH_3(CH_2)X$ COOH, where the carbon atom count includes the carboxyl group. The fatty or waxy acids utilized to produce the fatty or waxy acid salts that are incorporated into the composition of the intermediate layer(s) and/or the cover layer can be saturated or unsaturated, and they can be present in either solid, semi-solid, or liquid form.

Examples of suitable saturated fatty acids, i.e., fatty acids in which the carbon atoms of the alkyl chain are connected by single bonds, include, but are not limited to, stearic acid ($C_{18}$, i.e., $CH_3$ $(CH_2)_{16}$ COOH), palmitic acid ($C_{16}$, i.e., $CH_3$ $(CH_2)_{14}$ COOH), pelargonic acid ($C_9$, i.e., $CH_3$ $(CH_2)_7$ COOH), and lauric acid ($C_{12}$, i.e., $CH_3$ $(CH_2)_{10}$ COOH). An example of a suitable unsaturated fatty acids, i.e., a fatty acid having one or more double bonds between the carbon atoms in the alkyl chain, includes, but is not limited to, oleic acid ($C_{13}$, i.e., $CH_3$ $(CH_2)_7$ CH:CH$(CH_2)_7$ COOH).

The source of the metal ions used to produce the metal salts of the fatty or waxy acid salts that can be incorporated into the invention are generally metal salts that provide metal ions capable of neutralizing, to various extents, the carboxylic acid groups of the fatty acids. Example metal salts include the sulfate, carbonate, acetate, and hydroxylate salts of zinc, barium, calcium, and magnesium. Because the fatty acid salts utilized in the invention include various combinations of fatty acids neutralized with a large number of different metal ions, several different types of fatty acid salts can be utilized in the invention, including metal stearates, laureates, oleates, and palmitates, with calcium, zinc, sodium, and magnesium stearate being preferred, and with calcium and sodium stearate being most preferred.

The fatty or waxy acid, or metal salt of the fatty or waxy acid, is present in the modified ionomeric polymers in an amount in the range of preferably about 5 to about 45 weight percent (based on the total weight of the modified ionomeric polyer), more preferably about 7 to about 35 weight percent, and most preferably about 8 to about 20 weight percent. As a result of the addition of the one or more metal salts of a fatty or waxy acid, preferably about 40 to 100 percent, more preferably about 50 to 100 percent, and most preferably about 70 to 100 percent of the acidic groups in the final modified ionomeric polymer composition are neutralized by a metal ion. An example of such a modified ionomer polymer is DuPont® HPF-1000, available from E. I DuPont de Nemours and Co. Inc.

Other examples of modified ionomeric polymers for use in the composition of the intermediate layer(s) 24 and/or the cover layer 22 are those prepared by modifying (again with one or more metal salts of a fatty or waxy acid) ionomers based on the so-called bimodal ethylene/carboxylic acid polymers, as described in U.S. Pat. No. 6,562,906, the entire contents of which are incorporated by reference herein. These polymers are bimodal, because they result from the blending of two polymers having different molecular weights. The modified bimodal ionomeric polymers comprise:

a. a high molecular weight component having a molecular weight of about 80,000 to about 500,000, and including one or more ethylene/α,β-ethylenically unsaturated $C_{3-8}$ carboxylic acid copolymers, and/or one or more ethylene, alkyl (meth)acrylate, (meth)acrylic acid terpolymers; where the high molecular weight component is partially neutralized with metal ions selected from the group consisting of lithium, sodium, zinc, calcium, magnesium, and mixtures thereof;

b. a low molecular weight component having a molecular weight of about 2,000 to about 30,000, and including one or more ethylene/α,β-ethylenically unsaturated $C_{3-8}$ carboxylic acid copolymers and/or one or more ethylene, alkyl (meth)acrylate, (meth)acrylic acid terpolymers; where the low molecular weight component is partially neutralized with metal ions selected from the group consisting of lithium, sodium, zinc, calcium, magnesium, and mixtures thereof; and c. about 5 to about 45 weight percent (based on the total weight of the modified ionomeric polymer) of one or more fatty acids, or metal salts of a fatty acid, where the metal is selected from the group consisting of calcium, sodium, zinc, lithium, barium, and magnesium, and where the fatty acid preferably is stearic acid.

Again, the fatty or waxy acid salts utilized in the modified bimodal ionomeric polymers are composed of a chain of alkyl groups containing about 4 to about 75 carbon atoms (usually even numbered) and characterized by a —COOH terminal group. The generic formula for all fatty or waxy acids above acetic acid is $CH_3$ $(CH_2)$X COOH, where the carbon atom count includes the carboxyl group. The fatty or waxy acids utilized to produce the fatty or waxy acid salts incorporated into the invention may be saturated or unsaturated, and they may be present in either solid, semi-solid, or liquid form.

Examples of suitable saturated fatty acids, i.e., fatty acids in which the carbon atoms of the alkyl chain are connected by single bonds, include, but are not limited to, stearic acid ($C_{18}$, i.e., $CH_3$ $(CH_2)_{16}$ COOH), palmitic acid ($C_{16}$, i.e., $CH_3$ $(CH_2)_{14}$ COOH), pelargonic acid ($C_9$, i.e., $CH_3$ $(CH_2)_7$ COOH), and lauric acid ($C_{12}$, i.e., $CH_3$ $(CH_2)_{10}$ COOH). An example of a suitable unsaturated fatty acid, i.e., a fatty acid having one or more double bonds between the carbon atoms in the alkyl chain, includes, but is not limited to, oleic acid ($C_{13}$, i.e., $CH_3$ $(CH_2)_7$ CH:CH$(CH_2)_7$ COOH).

The source of the metal ions used to produce the metal salts of the fatty or waxy acid salts that are incorporated into the invention generally are metal salts that provide the metal ions capable of neutralizing, to various extents, the carboxylic acid groups of the fatty acids. Example metal salts include the sulfate, carbonate, acetate, and hydroxylate salts of zinc, barium, calcium, and magnesium. Because the fatty or waxy acid salts utilized in the invention include various combinations of fatty or waxy acids that are neutralized with a large number of different metal ions, several different types of fatty acid salts can be utilized in the invention, including metal stearates, laureates, oleates, and palmitates, with calcium, zinc, sodium, and magnesium stearate being preferred, and with calcium and sodium stearate being most preferred.

The fatty or waxy acid, or metal salt of the fatty or waxy acid, in the modified bimodal ionomeric polymers is present in an amount of preferably about 5 to about 45 weight percent (based on the total weight of the modified ionomeric polymer), more preferably about 7 to about 35 weight percent, and most preferably about 8 to about 20 weight percent. Again, as a result of the addition of the fatty or waxy acids, or one or more metal salts of a fatty or waxy acid, preferably about 40 to 100 percent, more preferably about 50 to 100 percent, and most preferably about 70 to 100 percent of the acidic groups in the final modified bimodal ionomeric polymer composition are neutralized by a metal ion.

Another example of a preferred ionomeric resin that can be included in the composition of the intermediate layer(s) 24 and/or the cover layer 22 is a blend including the reaction product of three components, (A), (B) and (C), which are characterized as follows:

a. Component (A) is a polymer comprising ethylene and/or an alpha olefin; and one or more α,β-ethylenically unsaturated $C_3$-$C_{20}$ carboxylic acids, sulfonic acids, or phosphoric acids.

b. Component (B) is a compound having a general formula $(R_2N)_m$-R'-$(X(O)_nOR_y)_m$, where R is either hydrogen, one or more $C_1$-$C_{20}$ aliphatic systems, one or more cycloaliphatic systems, one or more aromatic systems, or a combination thereof. Also R' is a bridging group including one or more unsubstituted $C_1$-$C_{20}$ straight chain or branched aliphatic or alicyclic groups, one or more substituted straight chain or branched aliphatic or alicyclic groups, one or more aromatic groups, or one or more oligomers each containing up to 12 repeating units. X can be C or S or P, and m can be 1, 2, or 3. For example, when X is C, n can be 1, and y can be 1; and when X is S, n can be 2 and y can be 1; and when X is P, n can be 2, and y can be 2.

c. Finally, component (C) is a basic metal ion salt, which has the capacity to neutralize some, or all of the acidic group present in the blend of components (A) and (B).

In particular embodiments, component (A) is an ethylene/α,β-ethylenically unsaturated $C_3$-$C_{20}$ carboxylic acid copolymer or an ethylene/α,β-ethylenically unsaturated $C_3$-$C_{20}$ carboxylic acid/α,β-ethylenically unsaturated $C_3$-$C_{20}$ carboxylic acid ester terpolymer. Component (B) is present in an amount from about 0.1 to about 40 phr, and Component (C) is a basic metal ion salt having a cation selected from the group consisting of $Li^+$, $Na^+$, $K^+$, $Zn^{2+}$, $Ca^{2+}$, $Co^{2+}$, $Ni^{2+}$, $Cu^{2+}$, $Pb^{2+}$, and $Mg^{2+}$.

In more specific embodiments, component (A) is a unimodal ethylene/(meth)acrylic acid copolymer or ethylene/(meth)acrylic acid/(meth)acrylate terpolymer; or a bimodal polymer blend composition. The bimodal polymer blend can include a high molecular weight component having molecular weight of about 80,000 to about 500,000, and comprising one or more ethylene/α,β-ethylenically unsaturated $C_{3-8}$ carboxylic acid copolymers and/or one or more ethylene, alkyl (meth)acrylate, (meth)acrylic acid terpolymers; which is partially neutralized with metal ions selected from the group consisting of lithium, sodium, zinc, calcium, magnesium, and combinations thereof. The bimodal polymer blend also can include a low molecular weight component having a molecular weight from about 2,000 to about 30,000, and comprise one or more ethylene/α,β-ethylenically unsaturated $C_{3-8}$ carboxylic acid copolymers and/or one or more ethylene, alkyl (meth)acrylate, (meth)acrylic acid terpolymers; the low molecular weight component being partially neutralized with metal ions selected from the group consisting of lithium, sodium, zinc, calcium, magnesium, and combinations thereof. Also, component (B) can be present in an amount from about 1 to about 20 phr, and can be selected from the group consisting of amino acids, polypeptides, carbamic acids, oxamic acids, anthranillic acids, and combinations thereof. Finally, component (C) can be a basic metal ion salt having a cation selected from the group consisting of $Li^+$, $Na^+$, $K^+$, $Zn^{2+}$, and $Mg^{2+}$, and combinations thereof.

In a more detailed feature of the invention, component (A) can be a unimodal ethylene/(meth)acrylic acid copolymer or ethylene/(meth)acrylic acid/(meth)acrylate terpolymer. Also, component (B) can be present in an amount from about 1 to about 15 phr, and can be either 4,4'-methylene-bis-(cyclohexylamine)carbamate, 11-aminoundecanoicacid, 12-aminododecanoic acid, epsilon-caprolactam, omega-caprolactam, or combination thereof. Finally, component (C) can be either a metal formate, metal acetate, metal nitrate, metal carbonate, metal bicarbonate, metal oxide, metal hydroxide, metal alkoxides, or combinations thereof.

In other embodiments, one or more of the previously discussed nanofillers are included in the thermoplastic or thermoset matrix polymer of the golf ball intermediate layer(s) 24 or golf ball cover layer 22.

The golf ball core composition according to the present invention can be mixed together, with or without melting the components of the composition. Mixing equipment, such as a tumble mixer, V-blender, ribbon blender, or two-roll mill, can be used to mix the composition. The golf ball core compositions can be mixed using a mill, internal mixer, extruder, or combinations of these, with or without application of thermal energy to produce melting. The unsaturated polymer, peptizer, and/or accelerator can be mixed together with a cross-linking agent, or each additive can be added in an appropriate sequence to the unsaturated polymer, e.g., peptizer, then accelerator, and then cross-linking agent. In another method of manufacture of these compositions, the peptizer, accelerator, and/or cross-linking agent can be added to the unsaturated polymer as part of a concentrate using dry blending, roll milling, or melt mixing. If radiation is the cross-linking agent, then the mixture comprising the unsaturated polymer and peptizer, with or without any additional chemical cross-linking agent, can be irradiated following mixing, during forming the golf ball core 12, or after forming.

The manufacture of the golf ball cores 12 according to the present invention can be in accord with conventional methods and conditions of manufacture. A preferred method for making golf ball cores within the scope of the present invention includes rubber compounding with a two-roll mill; followed by extrusion, resulting in a single slug of material; and then followed by compression molding, preferably in a single compression molding step, to induce cross-linking of the core material. Additional steps that can be included in the process for making the golf ball cores within the scope of the present invention include the following steps: preparing the core composition using an extruder; injection molding the core composition in a heated mold to induce partial or full cross-linking of the core material; and/or using additional cross-linking methods, for example, thermal energy, e.g., a post-cure of the core; or radiational energy, e.g., irradiation of the core.

Examples

Twelve batches of golf ball cores 12 having diameters of 1.48 inches or 1.58 inches, and suitable for use in golf balls 10 within the scope of the present invention, were prepared and tested for C.O.R.; compression ("C.C."); and Shore D hardness and specific gravity, which were measured at the core's outer surface 14 and the core's center point 16. The cores each incorporated 100 parts per hundred ("pph") of BR40, which is manufactured by Enichem of Rome, Italy; either 24.3 pph or 21.8 pph of ZnO; either 33.5 pph or 34.8 pph of SR638, which is manufactured by Sartomer Company; 0.61 pph of Varox 231XL, which is manufactured by R.T. Vanderbilt Company of Norwalk, Conn.; and 0.17 pph of Trigonox 145-45B, which is manufactured by Akzr Nobel Chemicals of Arnhem, Netherlands. The core compositions also include either 1 pph or 0.8 pph of $NH_4PCTP$. Detailed composition information for the twelve cores is provided in Table 1a below.

TABLE 1a

| Core # | Diameter (inches) | BR40 (pph) | ZnO (pph) | SR638 (pph) | Varox 231XL (pph) | Trigonox 145-45B (pph) | $NH_4PCTP$ (pph) |
|---|---|---|---|---|---|---|---|
| 1 | 1.48 | 100 | 24.3 | 33.5 | 0.61 | 0.17 | 1 |
| 2 | 1.48 | 100 | 24.3 | 33.5 | 0.61 | 0.17 | 1 |
| 3 | 1.48 | 100 | 24.3 | 33.5 | 0.61 | 0.17 | 1 |
| 4 | 1.48 | 100 | 24.3 | 33.5 | 0.61 | 0.17 | 1 |
| 5 | 1.48 | 100 | 24.3 | 33.5 | 0.61 | 0.17 | 1 |
| 6 | 1.58 | 100 | 21.8 | 34.8 | 0.61 | 0.17 | 0.8 |
| 7 | 1.58 | 100 | 21.8 | 34.8 | 0.61 | 0.17 | 0.8 |
| 8 | 1.58 | 100 | 21.8 | 34.8 | 0.61 | 0.17 | 0.8 |
| 9 | 1.58 | 100 | 21.8 | 34.8 | 0.61 | 0.17 | 0.8 |
| 10 | 1.58 | 100 | 21.8 | 34.8 | 0.61 | 0.17 | 0.8 |
| 11 | 1.58 | 100 | 21.8 | 34.8 | 0.61 | 0.17 | 0.8 |
| 12 | 1.58 | 100 | 21.8 | 34.8 | 0.61 | 0.17 | 0.8 |

The cores 12 were molded and cured at two different temperatures for various cure times, i.e., mold times. In addition to C.O.R. and C.C., the Shore D hardness and specific gravity values for the center point 16 and outer surface 14 of selected cores were measured as shown in Table 1b below. As shown in Table 1b, the value of C.O.R. and C.C. increased with cure time at 210° C. In fact, the properties of the cores that cured more than five minutes approach the properties of fully cured cores. Cores numbered 7-10 have a Shore D hardness difference between the core's outer surface and the core's center point of more than 15 units. The data for cores numbered 6-12 in Table 1b show that the specific gravity value measured at the core's center point gradually increases in value with the length of the cure time. For the core numbered 12, which cured for 10.5 minutes, the specific gravity values measured at the core's center point and the core's outer surface are almost the same value.

TABLE 1b

| Core # | Mold Temp (° C.) | Mold Time (min) | Center Hardness (Shore D) | Surface Hardness (Shore D) | Center Specific Gravity | Surface Specific Gravity | C.O.R. | C.C. |
|---|---|---|---|---|---|---|---|---|
| 1 | 180 | 12.0 | — | 46 | — | 1.220 | 0.830 | 79 |
| 2 | 210 | 2.5 | — | 41 | — | — | — | — |
| 3 | 210 | 3.0 | — | 43 | — | 1.183 | 0.815 | 51 |
| 4 | 210 | 3.5 | — | 43 | — | 1.186 | 0.817 | 56 |
| 5 | 210 | 5.0 | — | 45 | — | — | 0.828 | 77 |
| 6 | 210 | 1.5 | — | — | 0.962 | 1.052 | — | — |
| 7 | 210 | 2.5 | 27 | 46 | 1.093 | 1.162 | 0.817 | 56 |
| 8 | 210 | 3.5 | 27 | 48 | 1.109 | 1.167 | 0.826 | 71 |
| 9 | 210 | 4.5 | 33 | 48 | 1.080 | 1.160 | 0.826 | 78 |
| 10 | 210 | 6.5 | 32 | 52 | 1.133 | 1.161 | 0.829 | 79 |
| 11 | 210 | 8.5 | — | — | 1.154 | 1.172 | 0.828 | 84 |
| 12 | 210 | 10.5 | — | — | 1.182 | 1.184 | 0.827 | 81 |

The data shows that by adjusting the composition of the golf ball core 12, and adjusting the curing time and temperature of the core, the difference in hardness and specific gravity between a golf ball core's outer surface 14 and center point 16 can be altered as well as the resulting golf ball's C.O.R. and compression values. This results in golf balls 10 having lower spin rates, low C.C., and high C.O.R. Advantageously, the present invention allows for the flexibility to adjust ball performance, such as, spin rate, hit-feel, and durability during manufacturing.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention.

What is claimed is:

1. A golf ball comprising:

A. a golf ball core including:

i. a center point having a first hardness value, and ii. an outer surface having a second hardness value, different from the first hardness value, iii. wherein a gradient in hardness value between the first hardness value and the second hardness value across a radius of the golf ball core occurs in discrete increments, iv. and wherein regions of the golf ball core having discrete hardness values are arranged concentrically about the center point; and v. the center point has a first specific gravity value, vi. the outer surface has a second specific gravity value, different from the first specific gravity value, vii. wherein a gradient in the specific gravity value between the first specific gravity value and the second specific gravity value, across a radius of the golf ball core, occurs in discrete increments, viii. regions of the golf ball core having discrete specific gravity values are arranged concentrically about the center point; and ix. wherein a discrete specific gravity value for a region of the golf ball core is determined based on the equation $Y=0.03*X+B$, wherein:

a. Y is the specific gravity value of the region of the golf ball core, and $1<Y<1.3$;

b. X is a distance of the region from the center point of the golf ball core, 1 inch$<X<$1.62 inches, and the value of X can vary in value plus or minus 0.02 inch; and c. $0.95<B<1.27$; and B. one or more layers enclosing the golf ball core.

2. The golf ball according to claim 1, wherein the golf ball core has a point, along a radius between the center point and the outer surface, that has a third hardness value, different in value from the first hardness value and the second hardness value.

3. The golf ball according to claim 2, wherein the third hardness value is intermediate the first hardness value and the second hardness value.

4. The golf ball according to claim 3, wherein the third hardness value is greater than the first hardness value.

5. The golf ball according to claim 2, wherein the third hardness value is greater than both the first hardness value and the second hardness value.

6. The golf ball according to claim 1, wherein the golf ball core comprises an unsaturated polymer and a peptizer.

7. The golf ball according to claim 6, wherein the peptizer is selected from the group consisting of pentachlorothiophenol, a metal salt of pentachlorothiophenol, a non-metal salt of pentachlorothiophenol, and dibenzamido diphenyldisulfide.

8. The golf ball according to claim 6, wherein the golf ball core further comprises a cross-linking agent selected from the group consisting of diacetyl peroxide, di-tert-butyl peroxide, dibenzoyl peroxide, dicumyl peroxide, 2,5-dimethyl-2,5-di-(benzoylperoxy)hexane, 1,4-bis-(t-butylperoxyisopropyl) benzene, t-butylperoxybenzoate, 2,5-dimethyl-2,5-di-(t-butylperoxy)hexyne-3, 1,1-bis-(t-butylperoxy)-3,3,5-trimethylcyclohexane, di-(2,4-dichlorobenzoyl)peroxide, and mixtures thereof.

9. The golf ball according to claim 8, wherein the cross-linking agent is a mixture of organic peroxides, with each organic peroxide having a different activation temperature.

10. The golf ball according to claim 1, wherein the golf ball core further comprises a nanofiller.

11. The golf ball according to claim 10, wherein the nanofiller is intercalated with the matrix polymer.

12. The golf ball according to claim 10, wherein the nanofiller is exfoliated with the matrix polymer.

13. The golf ball according to claim 10, wherein the nanofiller is a clay is selected from the group consisting of hydrotalcite, montmorillonite, phyllosilicate, saponite, hectorite, beidellite, stevensite, vermiculite, halloysite, mica, micafluoride, and ostosilicate.

14. The golf ball according to claim 1, wherein the one or more of the layers enclosing the golf ball core include a polymer selected from the group consisting of thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene catalyzed polymers functionalized styrenic copolymer, functionalized styrenic terpolymer, styrenic terpolymer, cellulose polymer, liquid crystal polymer (LCP), ethylene-propylene-diene terpolymer (EPDM), ethylene-vinyl acetate copolymers (EVA), ethylene-propylene copolymer, ethylene vinyl acetate, polyurea, polysiloxane, and any metallocene-catalyzed polymers of these species.

15. The golf ball according to claim 1, wherein the one or more of the layers enclosing the golf ball core include a nanofiller clay selected from the group consisting of hydrotalcite, montmorillonite, phyllosilicate, saponite, hectorite, beidellite, stevensite, vermiculite, halloysite, mica, micafluoride, and ostosilicate and present in an amount between about 0.1% and about 20% by weight and said nanofiller is either is either intercalated or exfoliated within the polymer.

16. A golf ball core comprising:

a. a center point having a first hardness value; and b. an outer surface having a second hardness value, different from the first hardness value;

c. wherein a gradient in hardness value between the first hardness value and the second hardness value across a radius of the golf ball core occurs in discrete increments;

d. and wherein regions of the golf ball core having discrete hardness values are arranged concentrically about the center point; and e. the center point having a first specific gravity value, f. the outer surface having a second specific gravity value, different from the first specific gravity value, g. wherein a gradient in the specific gravity value between the first specific gravity value and the second specific gravity value, across a radius of the golf ball core, occurs in discrete increments, h. regions of the golf ball core having discrete specific gravity values are arranged concentrically about the center point; and i. wherein a discrete specific gravity value for a region of the golf ball core is determined based on the equation Y=0.03*X+B, wherein:

i. Y is the specific gravity value of the region of the golf ball core, and 1<Y<1.3;

ii. X is a distance of the region from the center point of the golf ball core, 1 inch<X<1.62 inches, and the value of X can vary in value plus or minus 0.02 inch; and iii. 0.95<B<1.27.

17. A golf ball comprising:

A. a golf ball core including:

i. a center point having a first specific gravity value, ii. an outer surface having a second specific gravity value, different from the first specific gravity value, iii. wherein a gradient in the specific gravity value between the first specific gravity value and the second specific gravity value, across a radius of the golf ball core, occurs in discrete increments, iv. regions of the golf ball core having discrete specific gravity values are arranged concentrically about the center point; and v. wherein a discrete specific gravity value for a region of the golf ball core is determined based on the equation Y=0.03*X+B, wherein:

a. Y is the specific gravity value of the region of the golf ball core, and 1<Y<1.3;

b. X is a distance of the region from the center point of the golf ball core, 1 inch<X<1.62 inches, and the value of X can vary in value plus or minus 0.02 inch; and c. 0.95<B<1.27; and B. one or more layers enclosing the golf ball core.

18. The golf ball according to claim 17, wherein a discrete specific gravity value for a region of the golf ball core is determined based on the equation Y=0.04*X+B, wherein:

a. Y is the specific gravity value of the region of the golf ball core, and 1<Y<1.3;

b. X is a distance of the region from the center point of the golf ball core, 1 inch<X<1.62 inches, and the value of X can vary in value plus or minus 0.02 inch; and c. 0.935<B<1.26.

19. The golf ball according to claim 17, wherein a discrete specific gravity value for a region of the golf ball core is determined based on the equation Y=0.05*X+B, wherein:

a. Y is the specific gravity value of the region of the golf ball core, and 1<Y<1.3;

b. X is a distance of the region from the center point of the golf ball core, 1 inch<X<1.62 inches, and the value of X can vary in value plus or minus 0.02 inch; and c. 0.919<B<1.25.

20. The golf ball according to claim 17, wherein the second specific gravity value is greater than the first specific gravity value.

21. The golf ball according to claim 17, wherein the golf ball core has a point, along a radius between the center point and the outer surface, that has a third specific gravity value, different in value from the first specific gravity value and the second gravity value.

22. The golf ball according to claim 17, wherein the golf ball core comprises an unsaturated polymer and a peptizer.

23. The golf ball according to claim 22, wherein the peptizer is selected from the group consisting of pentachlorothiophenol, a metal salt of pentachlorothiophenol, a non-metal salt of pentachlorothiophenol, and dibenzamido diphenyldisulfide.

24. The golf ball according to claim 22, wherein the golf ball core further comprises a cross-linking agent selected from the group consisting of diacetyl peroxide, di-tert-butyl peroxide, dibenzoyl peroxide, dicumyl peroxide, 2,5-dimethyl-2,5-di-(benzoylperoxy)hexane, 1,4-bis-(t-butylperoxyisopropyl)benzene, t-butylperoxybenzoate, 2,5-dimethy-2,5-di-(t-butylperoxy)hexyne-3, 1,1-bis-(t-butylperoxy)-3 , 3,5-trimethylcyclohexane, di-(2,4-dichlorobenzoyl)peroxide, and mixtures thereof.

25. The golf ball according to claim 24, wherein the cross-linking agent is a mixture of organic peroxides, with each organic peroxide having a different activation temperature.

26. A golf ball core comprising:

a. a center point having a first specific gravity value; and b. an outer surface having a second specific gravity value, different from the first specific gravity value;

c. wherein a gradient in the specific gravity value between the first specific gravity value and the second specific gravity value, across a radius of the golf ball core, occurs in discrete increments;

d. and wherein regions of the golf ball core having discrete specific gravity values are arranged concentrically about the center point; and e. wherein a discrete specific gravity value for a region of the golf ball core is determined based on the equation Y=0.03*X+B, wherein:

i. Y is the specific gravity value of the region of the golf ball core, and 1<Y<1.3;

ii. X is a distance of the region from the center point of the golf ball core, 1 inch<X<1.62 inches, and the value of X can vary in value plus or minus 0.02 inch; and iii. 0.95<B<1.27.

27. A method for forming a golf ball core, the method comprising:

a. providing a material that includes an unsaturated polymer and a peptizer; and b. molding the material into the golf ball core that has a center point and an outer surface;

c. wherein, after processing the golf ball core, the center point has a first hardness value and the outer surface has a second hardness value, different from the first hardness value;

d. wherein a gradient in hardness value between the first hardness value and the second hardness value, across a radius of the golf ball core, occurs in discrete increments;

e. and wherein regions of the golf ball core having discrete hardness values are arranged concentrically about the center point; and f. wherein the center point has a first specific gravity value; and g. an outer surface having a second specific gravity value, different from the first specific gravity value;

h. wherein a gradient in the specific gravity value between the first specific gravity value and the second specific gravity value, across a radius of the golf ball core, occurs in discrete increments;

i. and wherein regions of the golf ball core having discrete specific gravity values are arranged concentrically about the center point; and j. wherein a discrete specific gravity value for a region of the golf ball core is determined based on the equation Y=0.03*X+B, wherein:

i. Y is the specific gravity value of the region of the golf ball core, and 1<Y<1.3;

ii. X is a distance of the region from the center point of the golf ball core, 1 inch<X<1.62 inches, and the value of X can vary in value plus or minus 0.02 inch; and iii. 0.95<B<1.27.

28. A method for forming a golf ball core, the method comprising:

a. providing a material that includes an unsaturated polymer and a peptizer; and b. molding the material into the golf ball core that has a center point and an outer surface;

c. wherein, after processing the golf ball core, the center point has a first specific gravity value and the outer surface has a second specific gravity value, different from first specific gravity value;

d. wherein a gradient in the specific gravity value between the first specific gravity value and the second specific gravity value across a radius of the golf ball core occurs in discrete increments;

e. and wherein regions of the golf ball core having discrete specific gravity values are arranged concentrically about the center point; and f. wherein a discrete specific gravity value for a region of the golf ball core is determined based on the equation Y=0.03*X+B, wherein:

i. Y is the specific gravity value of the region of the golf ball core, and 1<Y<1.3;

ii. X is a distance of the region from the center point of the golf ball core, 1 inch<X<1.62 inches, and the value of X can vary in value plus or minus 0.02 inch; and iii. 0.95<B<1.27.

* * * * *